United States Patent [19]

Lenkoff et al.

[11] Patent Number: 4,586,714

[45] Date of Patent: May 6, 1986

[54] PUZZLE GAME

[75] Inventors: Leon G. Lenkoff; Roger J. Lenkoff; Patrick J. Garry, all of Louisville, Ky.

[73] Assignee: Stry-Lenkoff Co., Louisville, Ky.

[21] Appl. No.: 681,295

[22] Filed: Dec. 13, 1984

[51] Int. Cl.[4] ..... A63F 9/10; B32B 31/18

[52] U.S. Cl. ..... 273/157 R; 156/62; 156/249; 156/277

[58] Field of Search ..... 273/157 R; 156/62, 248, 156/249, 277

[56] References Cited

U.S. PATENT DOCUMENTS

| | | | |
|---|---|---|---|
| 1,217,632 | 2/1917 | Pritchard | 273/157 R |
| 3,002,309 | 10/1961 | Snyder | 273/157 R UX |
| 3,130,984 | 4/1964 | Fenberg | 156/248 X |
| 4,336,664 | 6/1982 | Penick et al. | 273/157 R X |

*Primary Examiner*—Anton O. Oechsle

*Attorney, Agent, or Firm*—Ralph B. Brick

[57] ABSTRACT

A puzzle game and a method of manufacturing the same including separate geometric segments of a total picture image removably fastened in jumbled fashion in a first defined area and a visibly marked grid in a second defined area forming the same geometrically shaped segments as in the first area whereby the jumbled segments can be transferred from the first area to the second area to form a correct picture image within the visible grid.

14 Claims, 5 Drawing Figures

PUZZLE GAME

BACKGROUND OF THE INVENTION (1) Field of the Invention

The present invention relates to puzzle games and, more particularly, to a unique and novel puzzle game wherein segments of a picture image are mounted in one area in jumbled fashion and can be transferred with facility to a visibly marked grid in a second area to correctly recompose the picture image.

(2) Brief Description of the Prior Art

Segmented jigsaw puzzles are well known in the game art wherein a picture image is divided into a plurality of various sized interlocking or dovetailing segments and separated in jumbled fashion for subsequent reassembly by a player in correctly recomposed form by interlocking the correct pieces.

The present invention provides a straightforward game puzzle which utilizes the basic jumbled picture and recompositon principle of the jigsaw puzzle game without necessarily requiring dovetailing or interlocking, making it easier and more attractive to young players and, at the same time, enhancing hand-eye coordination. In addition, the present invention provides a game puzzle which can be readily and economically manufactured in mass quantities to provide an attractive game puzzle product requiring minimum assembly, storage and playing space and yet affording many hours of educational entertainment to a young player. Further, the present invention provides a puzzle which can utilize and exercise selective matching and coordinating faculties of a young player, providing a game puzzle which is both educational and enjoyable. In addition, the present invention provides a unique puzzle product and method of manufacturing the same which utilizes the basic jumbled picture and recomposition principle, to produce a clear, continuous picture image when the jumbled picture image segments of the present invention are correctly recomposed.

Various other features of the present invention will become obvious to one skilled in the art upon reading the disclosure set forth hereinafter.

SUMMARY OF THE INVENTION

More particularly, the present invention provides a puzzle game comprising at least one first defined area having separate segments of a picture image removably fastened thereto, each of the segments being of preselected geometric shape and being removably fastened in the first defined area in jumbled picture image fashion; and a second defined area having a visibly marked grid thereon comprising the same number of segments as are removably fastened in the first area with each segment of the grid having a geometrical size and shape equivalent to the size and geometry of at least one of the segments removably fastened in the first area whereby segments transferred from the first jumbled area and fastened in the proper segments in the grid in the second area form a correct picture image. In addition, the present invention provides a novel method of manufacturing the game puzzle comprising the steps of: forming printing plate means for printing a visible grid of preselected geometric segments on a face of a supportive surface; reproducing a first picture image corresponding proportionally to the outer dimensions of the visible grid onto a severable second surface; severing the first reproduced picture image into a plurality of separate geometrical picture segments corresponding proportionally to the geometric segments of the visible grid; mounting the severed first picture segments in preselected composite spaced relation from each other on a supportive surface; extending the visual art of each of the picture segments in conceptual form beyond its peripheral edge into a portion of the space between segments a distance sufficient to accommodate for maufacturing severing tolerances; forming printing plate means for the composite extended picture segments when the extended picture segments are in jumbled form with the printing means size to print a puzzle of jumbled picture segments equal to the geometric segments of the visible grid on the supportive surface with extended picture image portions of such segments therebetween; feeding stock material composed of a print sheet adhesively and removably attached to a back-up sheet to the printing plate means to print the puzzle of composed jumbled picture image segments thereon with the extended portions therebetween; and severing the print sheet for removal of the jumbled picture image segments from the back-up sheet whereby the jumbled picture image segments can be selectively transferred from the back-up sheet to the segments of the visible grid on the supportive surface to correctly recompose the picture image.

It is to be understood that various changes can be made by one skilled in the art in the arrangement, form and construction of the novel product disclosed and in the several steps of the unique method disclosed without departing from the scope or spirit of the present invention.

BRIEF DESCRIPTION OF THE DRAWINGS

Referring to the drawings which disclose one advantageous embodiment of the present invention:

Referring to FIG. 1, the novel puzzle game broadly indicated by reference numeral 2 includes a supportive paper sheet 3 with one face 4 serving to provide a first defined area which, in the embodiment disclosed, can be flat. Positioned on face 4 of sheet 3 are a plurality of substantially square and equal segments 6 of a total picture image. Segments 6 are removably mounted on face 4 by a suitable pressure sensitive adhesive applied to the backing of the total picture image. The segments 6 are mounted in jumbled fashion or composition on face 4 of sheet 3 in spaced relation to each other and, as will be described in more detail hereinafter, each segment has had the visual art thereon extended in conceptual form along the peripheral edge thereof a preselected distance sufficient to accommodate for manufacturing tolerance and to insure clear, substantially uninterrupted picture assemblage when assembled as a composite picture, also in a manner as described hereinafter. It is to be noted that each segment 6 of FIG. 1 is provided with an indicia numeral identified in the drawing by reference numeral 7 to facilitate such assemblage into a comprehensive, clear total picture image. It is to be understood that other assembly indicia can be used besides numerals. For example, various other symbols such as alphabetic letters, stars, asterisks, moons, squares and the like could also be used to enhance the mating challenge of the puzzle. It, also, is to be understood that various geometric shapes besides square rectangles can be used for the segments of the puzzle to enhance or vary the puzzle scheme if so desired.

Referring to FIG. 2, a second defined area is provided by the other face 8 of sheet 3. It is, of course, to be understood that such second defined area can be in a location separate from sheet 3 if so desired. Printed on face 8 in a manner also described hereinafter is a visibly marked grid 9, the grid 9 having the same number of square grid segments 11 as are removably fastened to face 4 of sheet 3 with such segments 11 being of substantially equivalent geometric size and shape to receive segments 6 therefrom. It is to be noted each segment 11 is labeled with an indicia identified in the drawing by reference numeral 7′ which corresponds with a numeral of a picture segment to facilitate correct location of each segment 6 when transferring such segment from its jumbled picture on face 4 of sheet 3 to the grid 9 printed on the other face 8 of sheet 3. Thus, a novel puzzle, particularly entertaining and educational to a young child, is economically provided using a minimum of space and parts, the pressure-sensitive backing of the jumbled composite on face 4 of sheet 3 permitting ready transfer, with the mating indicia assuring correct placement in grid 9 on the opposite face 8 of sheet 3.

Referring to FIGS. 3 and 5 of the drawings, an advantageous embodiment of the novel method utilized in manufacturing puzzle game 2 is disclosed. Suitable line art of a picture image which is to be the subject matter of the puzzle game is selected. A multicolored picture image such as a clown or a cartoon character has been found to be most attractive for young puzzle solvers. A printing plate means for printing a visible grid of preselected geometrical segments such as the grid 9 of FIG. 2 is formed in a manner known in the art for mounting on an appropriate cylindrical printing and back-up roll pair 12, schematically disclosed in FIG. 5. The visible grid and the segments thereof are of a preselected dimension and shape to accommodate the final jumbled segments of the selected picture image to be transferred thereto. As disclosed in FIG. 2, grid 9 can be comprised of a plurality of substantially square, geometrically equal segments 11. A selected first picture image is reproduced to correspond proportionally to the outer dimensions of the grid.

Figure 1:
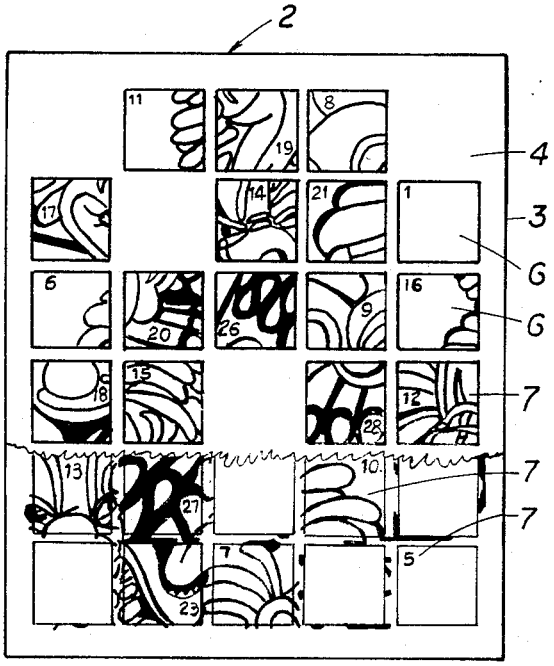
FIG. 1 is a plan view of most of the indicia marked segments of a picture image adhesively mounted in jumbled fashion on one face of a back-up sheet, the view above the break line showing the segments thereon in spaced relation, the waste material having been removed and the view below the break line showing the segments with the waste material remaining.
Figure 2:
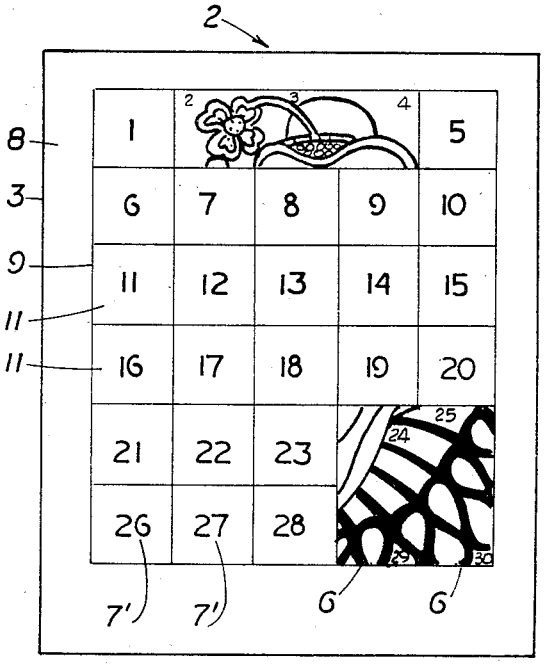
FIG. 2 is a plan view of a visible grid on a supportive surface, which can be the other face of the back-up sheet of FIG. 1, disclosing indicia numbered segments with the several indicia numbered removed segments of the picture image of FIG. 1 mounted in their correct segments of the grid.
Figure 3:
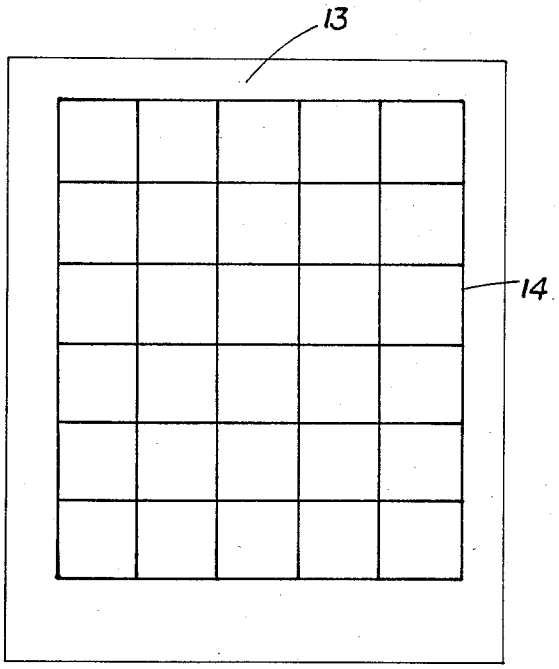
FIG. 3 is a plan view of a clear template used in dividing the first picture image into a plurality of picture image segments.

The reproduction can be accomplished on one face of a severable paper, the other face of which can be coated with a suitable adhesive or wax material which permits ready removal and adherence, a number of which materials are known in the art. If the preselected grid 9 and segments 11 are of a small size, the first picture image is suitably enlarged to permit selective segmentation. This can be accomplished by overlaying the first reproduced picture image with a first film positive, clear template 13 (FIG. 3). Template 13 has a grid 14 thereon which is of the same proportionality to the dimensions of visible grid 9 as is the enlarged first picture image. The template 13 with grid 14 thereon is moved relative to the first picture image to determine the best possible visual segmentation of the first picture image for puzzle purposes, avoiding any undesirable segmental cuts which might serve as visually identifiable puzzle give-aways or which might otherwise jeopardize visual puzzle integrity. Once the desired position or location of template 13 relative the first picture image has been determined, the first picture image is marked and cut. In the rectangular grid embodiment disclosed, suitable pins can be pushed through the extremities of the horizontal and vertical lines of grid 14 so that a pattern of marks are transferred unto the picture image which, when connected with a cutting knife, separate the picture image into a plurality of segments. Suitable indicia numerals 7 can be placed on the segments to agree with the order of numerals 7′ on grid 9.

Figure 4:
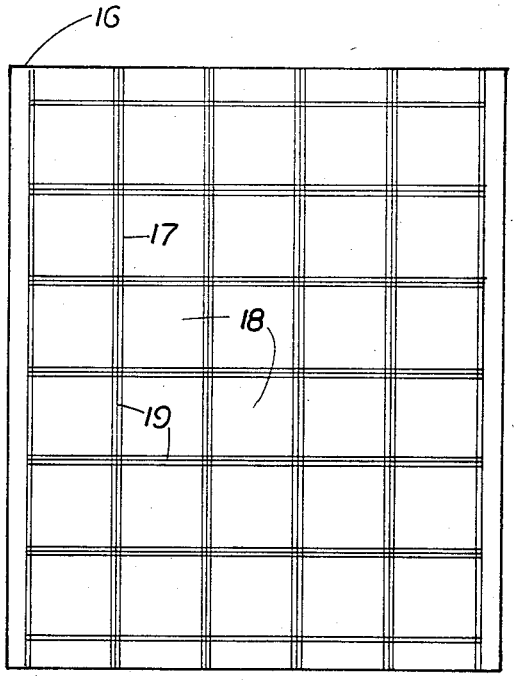
FIG. 4 is a plan view of another clear template used in locating the picture image segments in spaced relation for picture image conceptual extension; and, FIG. 5 is a schematic diagram of the machinery to carry out the inventive process involved in manufacturing the novel product.

Once the first picture image has been cut into segments with the segments appropriately bearing identifying indicia, the segments can be moved or transferred in random fashion to a blank sheet of translucent material which is placed in registration with clear film positive template 16 (FIG. 4). Template 16 has a first grid 17 printed thereon which includes spaced segments 18 that correspond in shape and size to the segments of the first picture image. A second grid 19 is printed on template 16 in superposed fashion over grid 16 so as to divide the spacing between spaced segments 18 of grid 16 into which the segments of the first picture image can be fastened in random fashion. Since the backing of the first picture image includes adhesive or wax as above-noted, the removal and transfer can be readily accomplished.

Once the segments of the first picture image are transferred to the spaced segments 18 of the second template 16, the conceptual visual art of each transferred picture image segment is extended into the space between the segments, the lines of grid 19 which divides the spaces between segments 18 serve to determine the limits of art extension. This conceptual extension of the art can be accomplished manually with an art instrument such as a brush or art pen or, if desired, can be accomplished mechanically by enlarging the first picture image an amount equal to the limit of the extension up to half of the spacing between segments 18 of grid 17 in the embodiment disclosed—making a plurality of such enlarged photographs and selectively cutting segments of the total picture from the plurality of duplicated photographs so that the peripheral edge of each segment extends to half of the preselected space between segments 18 of grid 17 or up to the lines of grid 19 which serves to divide the spaces between segments 18. It is to be understood that the random placement of segments of the first picture image can be accomplished, if so desired, after extension when conceptual extension is to be accomplished mechanically as above described.

Figure 5:
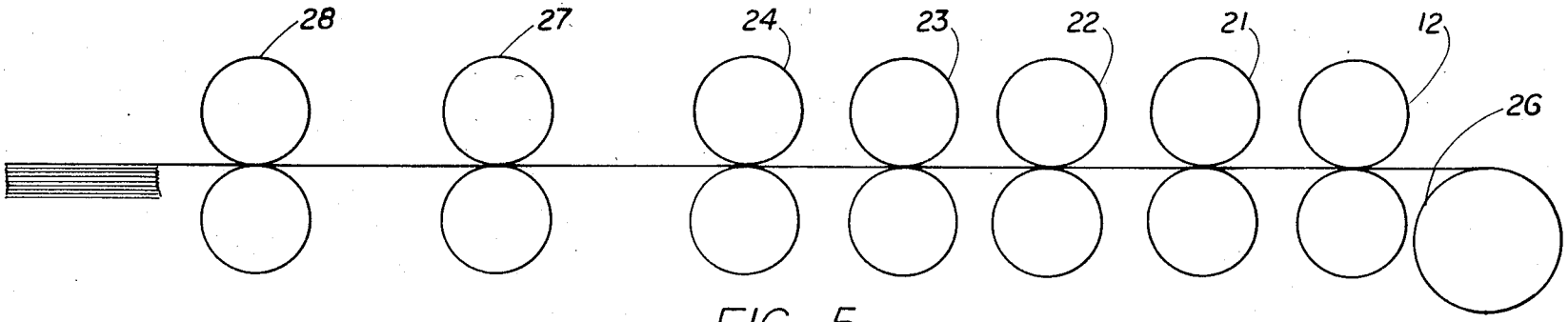

Once the picture image has been conceptually extended in random segment form, separate color overlays—advantageously of the four base colors red, blue, yellow and black are made. These extended overlays are so sized that the segments of the picture image produced thereby corresponds in size and geometry to the segments of the grid 9 to be produced by printing rolls 12. Accordingly, if the first picture image has been enlarged for purposes of production, the color overlays will be reduced. As with grid 9, suitable printing plates are formed for each color in a manner known in the art with each plate being mounted on an appropriate cylindrical printing and back-up roll pair. For example, in the schematic of FIG. 5, roll pair 21 can serve to accommodate the printing of suitable shades of yellow, roll pair 22 suitable shades of cyan, roll pair 23 suitable shades of magenta and roll pair 24, shades of black. It is to be understood that the color shades and the successive order thereof can be varied by one skilled in the art in accordance with the final results desired. It further is to be understood, that the template 13 and 16 aforedescribed can incorporate required distortion factors to accommodate for flexographic applications.

Again referring to FIG. 5, a suitable stock material 26 composed of a print sheet of paper adhesively and removably attached by a suitable pressure-sensitive adhesive in layer fashion to one face of a back-up sheet of paper is fed from a supply roll to the printing roll pairs 12 and 21–24 to print the puzzle of jumbled picture segments with extended picture portions on the print sheet adhesively attached to one face of said back-up sheet and the visual grid on the other face of the back-up sheet. From the printing roll pairs 12 and 21–24 the printed stock material passes through a pair of segment cutting die rolls 27 with a cutting die formed thereon in the form of a grid equivalent to grid 17 to cut the printed stock material into spaced preselected segments, on the back-up sheets, the extended picture portions thereof serving to accommodate for misalignments which might occur in the printing and die cutting roll steps. The remaining extended picture portions, which constitute waste after minor misalignments have been appropriately accommodated for by the extended picture portions can be left in place or peeled away from the back-up sheet, the printing and severing of the print sheet providing a continuous sheet of successive prints composed of removable, jumbled picture segments on one side of the back-up sheet with successive prints of grids 9 on the opposite side of the back-up sheet. The stock material is then passed to sheet cutting die rolls 28 which cut the material into sheets of single inventive puzzle games with picture image segments adhesively fastened to one side of the back-up sheet in jumbled fashion which can be transferred to appropriate segments of the grid on the other side of the back-up sheet to recompose the initial picture image in clear, continuous form without disturbing grid shadows which might otherwise develop through printing and cutting misalignments:

The invention claimed is:

1. A puzzle game comprising at least one first defined back-up sheet area having a print sheet which includes separate segments of a picture image removably fastened to said back-up sheet area, each of said segments being of preselected geometric shape and being removably fastened to said back-up sheet in said first defined area in jumbled picture image fashion; and a second defined back-up sheet area having a visibly marked grid thereon comprising the same number of segments as are removably fastened in said first area with each segment of said grid having a geometrical size and shape equivalent to the size and geometry of at least one of the segments removably fastened in said first back-up sheet area whereby segments transferred from said first jumbled area and fastened in the proper segments in the grid in said second area form a correct picture image, said segments of said picture image each having the visual art thereon extended in conceptual form beyond the edges thereof and onto the print sheet adjacent the peripheries of said segments a preselected distance sufficient to accommodate for manufacturing tolerance to insure clear picture assemblage in the visible grid in said second defined area.

2. The puzzle game of claim 1, said segments of said picture image having a pressure-sensitive adhesive backing to facilitate fastening and removal.

3. The puzzle game of claim 1, said segments of said picture image each having a visible distinct identifying indicia thereon corresponding with a visible distinct identifying indicia in a grid segment of said visibly marked grid in said second defined area to facilitate correct location of each segment in said visibly marked grid.

4. The puzzle game of claim 1, said segments of said visibly marked grid and said picture being of substantially rectangular shape.

5. A puzzle game comprising a first defined flat area having a print sheet which includes separate substantially square and equal segments of a total picture image removably mounted on said first defined flat area in jumbled fashion by a pressure-sensitive adhesive backing on said segments of said picture image; a second defined flat area having a visibly marked grid thereon comprising the same number of square grid segments as are removably fastened in said first area with said grid segments being of substantially equivalent geometric size and shape to the jumbled picture segments removably mounted in said first area, said jumbled picture segments each having a distinct visible indicia numeral thereon corresponding with a distinct visible indicia numeral in a grid section of said second area to facilitate its correct picture forming image location in said visibly marked grid; said segments of said picture image each having the visual art thereon extended in conceptual form beyond the peripheral edges thereof and onto the print sheet adjacent the peripheries of said segments a preselected distance sufficient to accommodate for manufacturing tolerance and insure clear, substantially uninterrupted picture assemblage in said visibly marked grid.

6. A method of manufacturing a game puzzle comprising: forming printing plate means for printing a visible grid of preselected geometric segments on a face of a supportive surface; printing the visible grid on a supportive surface; reproducing a first picture image corresponding proportionally to the outer dimensions of said visible grid onto a severable second surface; severing said first picture image into a plurality of separate geometrical picture segments corresponding proportionally to the geometric segments of said visible grid; mounting said severed first picture segments in preselected composite spaced relation from each other on a supportive surface; extending the visual art of each of said picture segments in conceptual form beyond its peripheral edge into a portion of the space between said segments a distance sufficient to accommodate for manufacturing severing tolerances; forming printing plate means for said composite extended picture segments when said extended picture segments are in jumbled form with said printing means sized to print a puzzle of jumbled picture segments equal to the geometric segments of said visible grid on said supportive surface with extended picture image portions of such segments therebetween; feeding stock material composed of a print sheet adhesively and removably attached to a back-up sheet to said printing plate means to print the puzzle of composed jumbled picture image segments thereon with the extended portions therebetween; and severing only the print sheet into a plurality of segments corresponding in size and shape to the segments of the grid on said supportive surface for removal of the jumbled picture image segments from said back-up sheet whereby the jumbled picture image segments can be selectively transferred from the back-up sheet to the segments of said visible grid on said supportive surface to correctly recompose said picture image.

7. The method of claim 6, wherein said picture segments of said first picture image are mounted on said supportive surface in spaced and jumbled composite relation from each other.

8. The method of claim 6, including using a film positive template with a grid printed thereon of the same proportionality to the dimensions of said visible grid as is said first picture and overlaying said film positive template on said first picture and moving it relative to said first picture to determine the best possible segmentation of said first picture for puzzle purposes immediately prior to the severing of said first picture.

9. The method of claim 6, including using a film positive template with a first grid printed thereon including geometric segments of the same proportionality to the dimensions of the geometric segments of said visible grid with said segments in composite preselected spaced relation from each other and a second grid printed thereon in superposed fashion over said first printed grid and arranged to divide the spacing between the spaced geometric segments of said first grid whereby said severed picture segments of said first picture are mounted in the spaced segments of said first grid and the visual art of each of said picture segments is extended in its conceptual form beyond its peripheral edge to the lines of said second grid.

10. The method of claim 6, wherein the extension of the visual art of each of said picture segments of said first picture image in conceptual form is accomplished manually with an art instrument.

11. The method of claim 6, wherein the extension of the visual art of each of said picture segments of said first picture image in conceptual form is accomplished mechanically by selectively severing each segment from one of a plurality of enlarged photographs of said first picture image enlarged so that the peripheral edge of each selective segment cut therefrom extends over half of the preselected space between said mounted segments.

12. The method of claim 6 wherein said printing plate means is formed by making appropriate separate color overlays of the extended picture and forming printing plates for each separate color.

13. A method of manufacturing a game puzzle comprising forming printing plate means for printing a visible grid of preselected substantially square segments on one face of a back-up surface; reproducing an enlarged first picture image corresponding proportionally to the outer dimensions of said visible grid onto an adhesive backed paper; overlaying said first picture image with a first film positive template having a grid printed thereon of the same proportionality to the dimensions of said visible grid as is said first picture image; moving said template relative said first picture image to determine the best possible visual segmentation of said first picture image for puzzle purposes; marking and cutting the first picture image into substantially square segments in accordance with said best possible visual segmentation; registering said substantially square segments of said first picture image in random fashion with correspondingly spaced segments of a second film positive template having a first grid printed thereon including such correspondingly spaced segments and a second grid printed thereon in superposed fashion over said first printed grid and arranged to divide the spacing between the spaced segments of said first grid into which the square segments of said first picture image have been inserted; extending the visual art of each of said randomly disposed first picture segments in its visually conceptual form manually with an art instrument; making separate color overlays of the extended picture so that the spaced images of the picture segments correspond in size and geometry to the segments of the printing plate means for printing a visible grid on one face of a back-up surface; forming printing plates for each separate color; feeding stock material composed of a print sheet adhesively and removably attached by a pressure-sensitive adhesive to one face of a back-up sheet to said printing plates to print the puzzle of jumbled picture segments with extended picture portions on said print sheet on one face of said back-up sheet and the visual grid on the other face of said back-up sheet; and severing the print sheet for removal of jumbled picture segments from said back-up sheet whereby the jumbled picture segments can be selectively transferred from the one face of the back-up sheet to said visible grid on the other face to correctly recompose said picture image.

14. The method of claim 13, including printing identifying numerals on the segments of the composite jumbled picture and on the segments of the grid to permit correct matching upon transfer of the segments from one face of the back-up sheet to the grid on the other face of the back-up sheet.

* * * * *